United States Patent [19]

Othmer

[11] 4,116,712

[45] Sep. 26, 1978

[54] SOLVENT REFINING OF SUGAR

[76] Inventor: Donald F. Othmer, 333 Jay St., Brooklyn, N.Y. 11201

[21] Appl. No.: 830,578

[22] Filed: Sep. 6, 1977

[51] Int. Cl.[2] ..... C13D 1/14

[52] U.S. Cl. ..... 127/46 R; 127/42; 127/53

[58] Field of Search ..... 127/46 R, 53, 63, 42; 210/21

[56] References Cited

U.S. PATENT DOCUMENTS

| | | | |
|---|---|---|---|
| 2,000,202 | 5/1935 | Vazquez | 127/47 |
| 2,109,503 | 3/1938 | Reich | 127/53 |
| 2,130,029 | 9/1938 | Reich | 127/53 |
| 2,442,804 | 6/1968 | Gaylor | 127/53 X |
| 2,759,857 | 8/1956 | Julsingha | 127/53 X |
| 3,174,877 | 3/1965 | Bohrer | 127/64 |
| 3,325,308 | 6/1967 | Othmer | 127/63 |
| 3,337,366 | 8/1967 | De Haas et al. | 127/53 X |

*Primary Examiner*—Morris O. Wolk
*Assistant Examiner*—Michael S. Marcus

[57] ABSTRACT

There are numerous impurities in beet and cane sugar in the two phases in which it appears in the food industry and in commerce: — as a solid phase in crystalline raw sugar, and as a liquid phase in concentrated syrups or molasses. These impurities, varying greatly with the source of the sugar, are extracted therefrom by solvents which are completely miscible with water, have molecular weights below 62 and contain a hydroxyl group: preferred solvents ethanol and acetic acid, also methanol. The crystalline nature of the solid raw sugar and the high solids content (40 to 80%) of such liquid solutions minimizes mutual solubility with the solvent which is enhanced by the use of a co-solvent — acetone, also completely miscible with water, also with a molecular weight below 62, and allows counter current washing of the raw sugar or the liquid-liquid extraction of the sugar syrups.

Impurities preferentially going to the solvent layer, and their extractability or the relative extractability of different impurities may be controlled by variation of (a) the solvent itself; (b) its water content; (c) its temperature; (d) its pH; (e) its ratio of admixture with acetone as the co-solvent, which reduces further the mutual solubility of the sugar and the miscibility with water; and particularly (f) the solids content of the syrup or molasses to be extracted.

Highly refined sugar either as the syrup or as crystal sugar is made from the raffinate of the liquid washing or extraction; and the impurities may be separated to recover values conventionally lost.

19 Claims, No Drawings

SOLVENT REFINING OF SUGAR

BACKGROUND OF INVENTION

Sugar is refined by this invention from both phases or forms in which it appears in industry and trade, as raw crystals or as syrups, i.e. concentrated solutions formed by evaporation and possibly other treatments of the concentrated juice from sugar beets or sugar cane. The impurities are also removed from two phase mixtures of sugar and water; e.g. solid raw sugar which carries a thin film of liquid phase molasses, also a massecuite of solid crystals in syrup. These impurities are largely concentrated in the solvent layer which is decanted at the end of the contacting operation as a solvent-extract liquid.

Impurities which must be removed may be classified as those which are very soluble in water, e.g. invert sugars, and those which are often present in much smaller amounts and are less soluble in water as oils, fats, and waxes. Both classes of impurities are washed or extracted by solvents from the solid raw sugar which may contain water in as low as 0.2% to 0.4% and total solids of 99.6% to 99.8%, a massecuite of larger water content, or a syrup having a water content of from 20% to 45% and a total solids (Brix) of 55% to 80%. The solvent has a molecule having a weight of less than 62 L and a hydroxyl group; and it is by itself completely soluble in water. A co-solvent — acetone — also completely soluble in water — is used in selected proportions. The impurities are thus removed from a water-sugar mixture in one or two phases containing water between 0.2% and 45%.

Known methods allow the recovery of the residual solvent and the working up of the purified sugar crystals or syrups to give substantially pure crystalline sugar or pure "liquid sugar" syrups; also the stripping of solvent from the extract layer; also the separation of the impurities remaining into their components — invert sugars, acids, fats or oils, waxes, chlorophyll, and molasses rich in vitamins. Some of these impurities have significant commercial values which are lost or destroyed in conventional refining processes. The solvent mixture is reused with little loss.

While this process will be used in conjunction with many known steps in sugar processing, its novelty resides in counter current flows and contactings by liquid washings or extractions of raw sugar crystals or of raw or otherwise impure sugar syrups of high concentration with mixtures of two volatile, water miscible, oxygenated solvents.

Cane juice is expressed and concentrated usually near the tropical plantation in a "central". During the final evaporation and "graining", a "strike" of crystals is formed. These grow and are separated to give a "raw" sugar containing several percent of impurities. Most of this raw sugar is shipped to be refined in the country where it is to be consumed.

By the novel process of this invention, essentially one or two counter current washings, extractions, or counter-current contactings of a stream of syrup by a stream of solvent, the concentrated juice may be converted to refined sugar at the central, and may then be shipped in bulk or otherwise to world markets; or refined syrups may be made from molasses or raw sugar; or the raw sugar, as conventionally made may be purified by washing i.e. counter-current contacting of a stream of it and a solvent mixture which can be produced on the site by fermentation of residual molasses. In another embodiment, cane juice is concentrated to 60–80% solids or Brix and shipped in bulk tankers for refining by the novel process in the country of use. Similarly syrups or molasses from beet juice may be purified without the large number of conventional physical and chemical treatment steps.

Sugar syrups, for the present purpose, are sugar solutions which are in the process of being refined. A molasses is a syrup resulting from a refining process which contains some or most of the impurities of the original syrup. For identification, a syrup molasses or raffinate molasses is one resulting from the separation of sugar crystals or syrup from what has previously been a less pure aqueous sugar-water mixture, while a solvent extract molasses is one resulting from a solvent extraction, either immediately after removal of the solvent — or after an evaporation-graining which may have allowed a strike and separation of sugar crystals.

The first step in the conventional refining of raw sugar is the washing off with aqueous sugar liquors of impurities present in a film of molasses on the yellow raw sugar. This is the so-called "affination" process and is done in a so-called "mingler", a horizontal scroll-conveyor-mixer, and then a centrifuge, to separate as much as possible of the syrup containing the impurities away from the crystals. This same mingler may be used to wash out the impurities from a heavy massecuite, a syrup containing a large amount of sugar crystals. With either raw sugar or massecuite it is desirable to operate with the solvent sluicing out extraneous solids as dirt, fiber, etc. from the sugar. These solids are separated then mechanically by settling or filtration from the solvent-extract liquid discharged.

For many years sugar refiners have tried to use ethanol in the affination of raw sugar without success, and for the liquid-liquid extraction of other solids, i.e. various impurities, away from a sugar syrup in a final molasses.

For example, Vazquez in U.S. Pat. No. 2,000,202 treated a concentrated molasses with a nearly anhydrous ethanol mixed with a second liquid such as ethyl acetate. This combination dissolved the impurities and precipitated or crystallized the sugar out in a mass or massecuite of crystals. The alcohol and impurities were removed as an extract molasses containing the impurities; and the sugar crystals were then later dissolved with more dilute alcohol from the insoluble impurities which remained.

Alcohol has been found to be a poor solvent for many of the impurities while it is, as noted in Vazquez, when somewhat diluted, a good solvent for the sugar — thus no industrial use has been reported of systems based on its use as: (a) an affination solvent, (b) an extraction liquid for impurities from a syrup or molasses, or (c) for precipitating crystals of sugar and washing them, then dissolving them as suggested in U.S. Pat. No. 2,000,202.

Bohrer U.S. Pat. No. 3,174,877 used methanol with 1 to 5% of a hydrocarbon to decolorize raw sugar in an affination, and showed that ethanol was definitely unusable for this purpose. His solvent was not chosen to remove other impurities of raw sugar, with which 3,174,877 was unconcerned.

Leonis U.S. Pat. No. 1,558,554 dried molasses and treated this with glacial acetic acid for 2 to 24 hours during which time the impurities evidently went into solution, the sugar was precipitated; and the impurities remained in the mother liquid.

Othmer U.S. Pat. No. 3,325,308 washed sugar crystals with pure methanol or pure acetic acid, separated the impurities in an extract molasses, removed the solvent therefrom; and then, out of this molasses, extracted with acetone the oils, fats and waxes for which the acetone has an excellent selectivity.

Acetone was also used with molasses from other sources to extract the oils, fats, waxes therefrom and to leave the highly water soluble inverts with the raffinate stream of sugar syrup.

THE NEW SOLVENT EXTRACTION PROCESS

Now there have been found suitable solvents for extraction of impurities including invert sugars and other highly water soluble materials from sugar crystals and syrups. These are liquids with oxygenated molecules having a weight below 62 and containing a hydroxyl group. They are mixed with an appropriate amount of acetone — also oxygenated, completely soluble in water, and also having a molecular weight below 62. Thus a solvent mixture of acetone with ethanol as well as with either methanol or acetic acid, but without their respective disadvantages, may be used for this washing and refining of raw sugar crystals or of sugar syrups or molasses. This washing with the solvent mixture of acetone and the hydroxyl type solvent is done by passing the raw sugar in a horizontal scroll conveyor, a mingler, against a counter current stream of the mixed solvent which dissolves the impurities from the crystals and hydraulically sluices or carries in the liquid stream miscellaneous solids as dirt, fibers, etc. These solids are then separated by settling or filtering of the solvent — extract molasses, after its withdrawal from the mingler. The solvent is evaporated from the extract molasses for reuse.

Furthermore, if instead of crystallizing out raw sugar from the concentrated juice from beets or cane to be refined later — and in a different country — the impure juice may be concentrated at the raw sugar house so that it has a solids content or Brix of from preferably 55 to 80%, although under some conditions as low as 40 or 50. Most of this content of solids is sugar. This heavy impure syrup may be shipped in bulk tankers for refining overseas, thus the higher concentration, less water saves shipping tonnage. The impurities may be removed, as desired, either at the point of origin or that of destination by liquid-liquid extraction from the aqueous solution or syrup itself. From this purified syrup — the liquid raffinate — the refined sugar is then crystallized in the conventional evaporator-grainer. Some small amounts of impurities are separated in a syrup molasses or a raffinate molasses containing invert sugars. Impure sugar syrups which are obtained during conventional refining operations may be refined similarly.

The solvent — extract is worked up by other steps of the invention or by well known processes to remove and to separate the invert sugars and the other impurities for their respective values. A "strike" or crystallization and separation may be made of comparatively low purity sugar crystals, sometimes, to leave an extract molasses of the impurities in a highly concentrated form — for later break down if desired by known methods.

The use of the preferred water soluble solvents of this invention — acetone mixed with methanol, ethanol, or acetic acid — to wash or extract away the inherent impurities of beet or cane sugar is thus accomplished while the impure sugar is in either one or the two phases in which it is common in the food industry and commerce: (a) from the solid phase of raw sugar crystals, by a washing comparable to a conventional affination in a standard scroll conveyor or mingler, or (b) from the liquid phase of an impure but quite concentrated sugar syrup or molasses by a counter-current liquid-liquid extraction.

The invention also may be used counter currently to extract the impurities from a massecuite or mixture of raw sugar crystals in a molasses; i.e. from both phases simultaneously. Thus, since raw sugar may have a minimum of about 0.2% water and the maximum water in a syrup or molasses to be extracted would be 40%, or preferably less, the removal of impurities by counter current contacting by the solvent mixture would include mixtures of solids (principally sugar) and any amount of water between 0.2% and 60% of the solids-water mixture, preferably 0.2% to 45% water.

Essentially the new invention has differentiated the two types of impurities found in sugar-water mixtures, (a) inverts and other highly water soluble ones, and (b) oils, fats, waxes and other much less water soluble ones; and has found then, satisfactory solvent mixtures for their separation. Completely water soluble solvents have been found which in their mixtures always include one of these, acetone. The hydroxyl type solvents are good for removing the more water soluble impurities. Acetone is particularly good for removing the less water soluble impurities; and its mixture with ethanol allows it to be used effectively in washing sugar crystals. Also its use in mixtures with the hydroxyl type solvents permits the simultaneous extraction of both types of impurities — presumably the first by the hydroxyl type solvent and the second by the acetone. The action of the acetone in the solvent mixture permits the extraction of an aqueous solution — the syrup or molasses — by an entirely water soluble mixture of solvents.

ADVANTAGES OF THE NEW PROCESS

By the new process there is no necessity of first crystallizing raw sugar and its subsequent dissolution, and the consequent evaporation of all of the water used, as conventionally practiced with cane sugar, with its high cost for steam — and hence fuel. Thermal energy costs for this evaporation are a principal operating cost of cane sugar refineries; and the saving by conventional methods may be between 15 and 60%.

Raw sugar may be pumped and shipped as a syrup in bulk tankers with a solids content up to 80 or 85 Brix for refining from the liquid phase. Handling and transportation costs are greatly reduced compared with those for conventional crystal shipping — particularly when in bags.

In processing raw, crystalline sugar, a refined product may be obtained with one of the preferred solvents together with a co-solvent, acetone, which is also completely soluble in water. This solvent mixture when ethanol is used does not have the disadvantages of other solvents previously used. The yield and purity of the refined sugar as crystals or as a refined syrup is improved significantly, because of the reduction in the large number of steps of conventional processing of either cane or beet juices to give sugar.

The purer sugar or sugar syrup produced from impure sugar in either the solid or the liquid form or phase is comparatively free from bacteria and spores because of their incompatibility with the solvents used, while conventionally refined sugar always contains one or usually both.

Valuable products may be recovered from impurities conventionally destroyed or discarded, but which may be separated as such by known processes, or concentrated for use; thus vitamins present in the original juice are concentrated in a final molasses of excellent taste, with little of their almost entire loss by conventional processing.

The impurities are removed by a solvent — or solvents — which, by evaporation, may be recovered for reuse with very little loss and a relatively low energy cost as compared to the usual systems using treatments with chemicals or solid adsorbents. Such treatments have high costs for labor and materials — as loss of adsorbents, also high plant costs as they destroy the value of the impurities. Particularly the prior art has a high energy cost for its several steps by whatever process used.

The total cost of adsorbents — chars, activated carbons, and other chemicals used in the production of a pure sugar or syrup is eliminated or reduced significantly.

The time necessary for refining is reduced, with worth-while saving in the large inventory of sugar which is resident in the operation, also in the degradation of sugar materials during this time required for processing.

Equipment and plant sizes and costs are reduced because of the very much simpler processing, and the removal of so much of the product sugar in the first steps — with very small amounts to be handled in much smaller equipment in subsequent steps.

REQUIREMENTS OF SOLVENTS WHICH WILL REMOVE IMPURITIES FROM RAW SUGAR SYRUPS AND CRYSTALS

Oxygen probably is present in the molecules of all of the organic impurities in sugar juices, syrups, and raw crystals. Especially cane juice contains invert sugars, which are carbohydrates. These and many less readily identified materials are very soluble in water. There are also other impurities which are much less soluble in water such as oils or fats and waxes. Also there are solid acids — of which aconitic acid is usually the largest in amount, and it may be referred to as a representative of all solid acids — chlorophyll and other coloring matter, and other materials of unidentified composition, also significant amounts of a half dozen vitamins. Beet juices contain many acids and their salts — notably oxalic — also various organic nitrogen compounds. All of these contain oxygen.

Experience with washing or extraction with solvents indicates that those with highly oxygenated molecules might be expected therefore to dissolve just these types of materials. Also such solvents have specific gravities which are low compared to the higher ones of the heavy sugar syrups or crystals — thus phase separation is rapid. Unfortunately, however, these solvents which would be expected to be useful always have large mutual water solubilities, thus they are completely miscible in all proportions. Always they have been discarded for this reason from consideration for the liquid-liquid extraction of any material from aqueous solutions — here those of sugar, and indeed for the extraction of impurities from raw sugars because of their high solubilities for sugar in the presence of a little water.

SELECTED SOLVENTS WHICH ARE ENTIRELY MISCIBLE WITH WATER

It has now been found, however, that each of a class of solvents which is entirely miscible with pure water has very much lower solubilities with highly concentrated sugar solutions or syrups, i.e. those above about 55 Brix — sometimes as low as 40 to 50 Brix, although this solids content of the syrup varies with some other factors discussed later. A preferred range is 55 to 80 Brix. Therefore, a study of the properties of solvents which might be used was undertaken to determine if such an oxygenated solvent might be found to extract from impure sugar crystals, syrups or massecuites those materials or impurities which dissolve by themselves in the particular solvent. It was first found that the large amount of dissolved sugar depresses the solubility of water in the syrup for or into a selected solvent, just as it significantly depresses the vapor pressure and elevates the boiling point of water out of the syrup; but in practice it is necessary to mix with this preferred oxygenated solvent an amount of acetone — also completely miscible in water to give a mixed solvent, still completely miscible with water which, however, is immiscible with the syrup.

The desired solvent not only should be highly oxygenated, it should be inexpensive and volatile so as to be easily recovered for reuse by well known methods — which are not a part of this invention — but not so volatile as to make difficult the prevention of its loss. Among the many commercially available solvents, those which have been found to be suitable are liquids containing a hydroxyl group in the molecule and having a molecular weight below 62. These may be called the hydroxyl type solvents. The preferred two are acetic acid and ethanol — these each contain two carbon atoms, are quite satisfactory, and may be readily produced by fermenting low value sugar liquids. A third solvent — methanol also may be used, although it has some disadvantages. All of the oxygenated solvents — including those of the hydroxyl type — have densities much below those of the concentrated sugar solutions; thus phase separation in an extractor is rapid and complete. Particularly the highly water soluble impurities of the sugar — e.g. the inverts, are selectively extracted by the hydroxyl type solvents.

When used with sugar syrups of the desired concentration, 55–80 Brix, there is added a selected amount of the co-solvent, acetone, which is also completely miscible in water alone. Acetone also markedly improves the washing of raw sugar crystals, or these crystals in a massecuite with molasses since it has higher selectivity for the oils, fats, waxes than does the hydroxyl type solvents. It is readily available, inexpensive, and also produced by fermentation of low value sugar liquors.

Depending on the composition and Brix of the syrup, its temperature and pH, also the water content of the solvent, the efficiency of the extractor, and the ratio of co-solvent to hydroxyl type solvent, the total solvent to syrup ratio by volume or the solvent to massecuite ratio by volume for the extraction (or the solvent — raw sugar ratio by weight) may be about 1 to 1, although in both cases this may vary from 0.3 to 1 as a low, to about 3 to 1 as a high.

It has now been found that ethanol as well as methanol and acetic acid — in general the hydroxyl type solvents — are effective when mixed with acetone.

Very small amounts of water may sometimes be added — in amounts of less than 5%.

In one of the embodiments of the present process, these hydroxyl solvents, with co-solvent acetone are used quite differently — as an immiscible solvent phase contacting and extracting of solids away from and out of the aqueous syrup phase. A counter-current contacting or liquid-liquid extraction of an impure original sugar syrup or massecuite by the mixed solvent results in (a) the purified or refined syrup or massecuite as the raffinate, and (b) the solvent — extract containing much or substantially all of the impurities.

Both of these "layers" or streams leaving the extractor have the mixed solvent dissolved therein, which first must be removed for reuse by evaporation and other known steps. The refined syrup may be used as such; or a grain formation may be inaugurated. The crystallization then gives refined sugar therefrom. In some cases, it may be possible simply to cool the refined syrup after the extraction, or after the stripping of the solvent therefrom to crystallize out the refined sugar. From such refined crystals is separated a syrup or raffinate molasses which is a conventional refiner's syrup.

This mixture of completely water miscible solvents, i.e. one of the hydroxyl type with an appropriate amount of the co-solvent acetone, is used for the removal of impurities by their extraction, using only a low volume ratio of the solvent mixture to the raw sugar crystals or to the concentrated sugar syrup. Such a counter current contacting, washing, or extraction takes the place of conventional refining with its many separating operations using various chemicals, adsorbents and their revivification plants, etc.

It gives immediately in the case of washing the crystals of raw sugar in a horizontal mingler the dissolution of soluble impurities and the sluicing away hydraulically of solid impurities, thus a refined sugar; and, in the case of an impure syrup, a syrup and then crystal sugar of high purity, in high yield. The later steps, well known in the art, are few in number compared to the large number in a conventional central or sugar refinery, and are worked with very small equipment because a very large amount of the sugar has been obtained as pure crystal or syrup in the first steps, and the impurities are immediately highly concentrated in a small volume. Thus the units for subsequent processing, are comparatively very small.

DILUTION OF SOLVENT IN EXTRACTING SYRUPS

One very important and unexpected parameter has been found which greatly affects the applicability and effectiveness of the desired separation by the partition of impurities between a sugar syrup and the hydroxyl solvent mixed with acetone. This added variable is indeed a whole new dimension in the operation of a liquid-liquid extraction operation, and is most uncommon, if indeed not unknown in such operations with other materials. It is the amount of water which may be used as a diluent in the water soluble hydroxyl type solvent with its co-solvent acetone as it is used to contact the syrup counter-currently. Since both solvent and co-solvent are entirely miscible with water — as are ternary mixtures of all proportions — there is no limitation on the amount which might be used — except, of course, the utility as a solvent for the mixture so formed.

Water may be added to from 1% to a maximum of 5% by volume of the solution of the hydroxyl type solvent with acetone as it enters the washing or extraction of raw sugar, either as the crystals or as the syrup. Its amount in the solvent mixture may be somewhat more or less as it leaves, since the solvent may extract water from or give up water to the sugar syrup; usually when used with raw sugar crystals, it will extract water from them. If, for example, glacial, i.e. anhydrous acetic acid is available, its dilution with water in an amount of about 1 to 5% of its volume increases its solubility for the invert sugars while lowering somewhat its effectiveness for dissolving oils, fats and waxes. However, the amount of co-solvent acetone present minimizes this defect. Addition of more than 5% water to the combination of solvents, always entirely water soluble, may prevent liquid-liquid extraction of syrups and dissolves much sugar from crystals.

Aside from considerations of solubilities of impurities, it is desirable to use the acetic acid containing as small an amount of water as possible, to minimize its ionization — which is much less at the highest concentrations — and thus its tendency to invert the sugar. The amount of inversion is small, however, in the short time required for the extraction. Furthermore, the minimum of water is desirable in the operation for recovery of the acetic acid for reuse.

The water content used in the solvent depends on that of the syrup to be extracted — and this also may frequently be modified to give an optimum extraction performance by the concentration obtained in the evaporation of the syrup just before the extraction.

In general, the final concentration of the syrup as such or of the syrup crystallizing as a massecuite requires the removal of a fixed amount of water from the original juice — and only so much because there need be no redissolution of the crystals and re-evaporation of the syrup. Thus the selection of the desired concentration for the liquid-liquid extraction — or even including the concentration on crystallizing to a raw sugar — may be made at the optimum Brix for the contacting with the solvent, then a further evaporation — hence use of heat for concentrating the syrup — should not change.

Moreover, if an extractor is to be used which has one or more multiple equilibrium units for contact of two phases, solvent and syrup, if the two materials are not in equilibrium on entering, e.g. if the solvent layer is not carrying sufficient water to be in equilibrium with the syrup, it will extract water from the syrup. The reverse is also the case. Thus within the wide range of total solids concentration or Brix of the syrups which may be extracted, the limiting water content of the solvent will be controlled, less water in the solvent used with less concentrated syrups, and more water in the solvent used with more concentrated syrups. This control of water content is based also on the fact that its presence increases the solubility of the solvent which carries it for the invert sugars and other highly water soluble impurities in the syrup.

A consequence is that a hydroxyl type solvent undiluted with water, of which glacial acetic acid is an example, will always extract water from the raw sugar-syrup or crystal in fact — if used in too large a ratio to the volume of the syrup being extracted — may reduce the water, thus increase the solids-water concentration, to a point where the syrup crystallizes out solid sugar. This is quite undesirable.

Another important aspect of this use of hydroxyl solvents in liquid-liquid extraction of syrups has thus been developed. At one end of the extractor operation is the entrance of the solvent, e.g. acetic acid — not necessarily, but nearly, anhydrous and containing the co-solvent acetone. Here the selectivity of the solvent is highest for oils, fats, waxes and other materials relatively less miscible in water. As the solvent proceeds through the intimate contacting with the syrup in the extraction operation, and depending on the effectiveness of the co-solvent to reduce its mutual solubility for water, it extracts some water from the syrup (along with the particular impurities) and becomes somewhat diluted. This increases its effective solubility and particularly its speed of dissolution of the inverts, as it is dissolving also the other relatively water soluble impurities. Thus substantially all of these highly water soluble impurities are extracted into the solvent phase as it passes toward the other end of the extractor.

The extraction operation, conducted so as to take advantage of this changing solubility and extractability of the water-miscible hydroxyl type solvents — due to the changing water content of the solvent — in relation to the syrup, is one of the features of the invention. This advantageous situation depends on the fact that the impurities, which are relatively water insoluble are extracted at the end of the extractor, just before the discharge of the syrup, where the solvent enters, nearly anhydrous, and where it has its maximum partition coefficient for relatively water insoluble materials. However, these impurities of lesser water solubility, because of their small amount, are retained in solution in the solvent as it becomes diluted in extracting water from the syrup in going through the extractor and especially in extracting the more water soluble impurities as the inverts.

Thus this additional small amount of water extracted by the solvent during the operation, while effectively increasing the extractability for the inverts and other more water soluble impurities at the solvent discharge (syrup inlet) end of the extraction operation, does not cause the dissolution of the less water soluble impurities already extracted by the solvent when it contained less water. In effect, in the operation of this novel process this change in selectivities or solubilities due to changing amounts of water in the solvent has been found to improve what may be called the counter-current characteristics of the extraction which is, of course, mechanically operated counter-currently.

TEMPERATURE OF EXTRACTION OF SYRUPS

Every solvent for any washing or extraction is chosen for its partition coefficient or selectivity for the desired materials being separated away from the original, here raw sugar crystals or syrups. Solvents, which normally are entirely miscible with water, may be used with the co-solvent, acetone — also entirely miscible with water — because the large sugar concentration when used with a syrup attracts and holds the water, and largely prevents its mutual dissolution into and out of the solvent. However, the selectivity for the impurities to be extracted — as well as the basic ability to use the solvent as an extractant — varies with the Brix or concentration of solids of the syrup. Generally the selectivity of the hydroxyl type solvent with acetone as co-solvent for the impurities has been found to increase — i.e. allows better purification — with increasing Brix. This should be at least 40 or 50 representing 40 to 50% total solids, and desirably above 55 Brix and from this range on up to 75 or 80 Brix.

Higher concentrations of syrups can be obtained — and maintained during the extraction — only at temperatures well above the ambient; and such temperatures, even with lower syrup concentrations; greatly reduce the viscosity of the syrup, hence minimize the power required for whatever type of mechanical liquid-liquid extractor is used. Also, because of the better contact which may be obtained of the two liquid phases in the extractor with the lower viscosity of the syrup, the time of contact necessary for the extraction is reduced at the higher temperatures. The extractor used will have from 1 to 10 equilibrium units, usually between 2 and 5.

It has been found that the optimum temperature for extraction of the syrup may be above the normal boiling point of the solvent chosen, e.g. ethanol when mixed with the co-solvent, acetone; and, if so, the extraction is conducted in a sealed unit under sufficient pressure to keep the solvent always in the liquid phase.

Just as in the use of dilution and a gradient in water content of the solvent throughout the extraction to improve the operation, the temperature may be varied in some cases to advantage, depending on the particular syrup and its impurities. For example, if the syrup is fed to one end of the extractor at 80° C. and the solvent enters the other end at 20° C., the syrup will be cooled in the extractor as the solvent is heated, so that advantage may be taken of variance of the partition coefficients with temperature of the different impurities. This may be particularly important in the operation near the two ends of the extractor.

The extraction may be conducted at the highest temperature of the discharge from the evaporator which concentrates the original juice to the desired high Brix. Some further water removal may take place, as noted above, through its extraction by the solvent, if this contains no water, or too small an amount to be in equilibrium with that in the syrup. This further concentration of the syrup and the accompanying slight dissolution of some of the solvent in the syrup is controlled usually so that its solubility for sugar will not be reduced sufficiently to induce grain formation, i.e. starting of the crystallization of sugar, even though there is simultaneously a cooling of the syrup. However, a minor grain formation will be of very small crystals which will have been formed; and these are carried in the syrup and not in the solvent. Because of the extremely large numbers of very fine crystals formed, this will prevent the growth of a proper size crystal.

With, or, without, such minor grain formation during the extraction operation, the purified syrup is withdrawn; and the solvent is removed by evaporation or otherwise, e.g. in a multi-cell evaporater where crystals are allowed to form and grow in the conventional manner. The main crystallization is accomplished in the usual grainer pan operation with one to several strikes (crystallizations from the so-called massecuite) or a first strike may even be made by simply cooling the syrup if it has been sufficiently concentrated in the prior evaporation and/or by the removal of water during the extraction. The operation for the production of sugar is conventional; and, instead of crystal sugar, either a refiner's syrup or an ultimate molasses may be produced, depending on the impurities present, the efficiency of the extraction operation and the markets for products.

pH OF SYRUP

Another modification of the extraction operation which is very effective in improving the selectivity of the solvent for the impurities in either a raw sugar or an impure syrup is an adjustment of the pH. The syrup may be acidified by a mineral acid to a pH of 1.25 to 1.3 just before the extraction, taking a relatively short time, or alternatively, a small, carefully controlled amount of mineral acid may be added to the solvent. The mineral acid "springs" the organic acids present as impurities in the raw sugar or syrup to release them from their salts; and the partition coefficient of the solvent from them out of the syrup has been found to be increased by 10 to 100 times or more as compared to that for the salts. As the acids are extracted by the solvent — or sprung and extracted if the mineral acid is in the solvent — the pH of both the solvent and of the syrup will vary throughout the height of the extractor, just as the temperature and the water content of solvent and syrup have been found to vary.

Particularly important is this acidification also in removing coloring minerals which show an "indicator" effect. Usually as salts they have a light straw to brown coloration. However, the acids which are formed when the pH is lowered may be comparatively colorless; and, compared to the salts, they are readily extractable by the hydroxyl solvents with the co-solvent, acetone. Use of hydrochloric acid gives soluble salts with the ions of magnesium or calcium, the usual metallic ions in the syrup — these salts will remain with the syrup — in any case, they remain in a final molasses, usually in such a small amount as not to affect its properties. Sulfuric acid or phosphoric acid gives insoluble salts which are carried in the syrup as small particles; and these may be removed in any subsequent filtration of the syrup.

After the extraction, lime and later carbon dioxide may be used to adjust the pH, then the syrup may be filtered as in conventional practice to "polish" it. Usually this is not necessary.

It is worthwhile to note the several conditions which may be adjusted in the process design of the new method to improve its flexibility for particular separations. Besides: (a) the usual one of the choice of the solvent, these includce: (b) the amount of acetone as co-solvent, (c) the amount of water in the solvent mixture — not over 5%, (d) the concentration of solids i.e. Brix of the syrup, (e) the temperature of the operation and (f) the effective pH of the syrup. As has been described, these must be considered in relation to each other because of their mutual inter-dependency; and all of these except the first two may be varied during and from end to end of the extraction operation itself when such variation is advantageous for the removal of the impurities present in a particular syrup.

All of these variables are considered and adjusted to give the greatest degree of separation in purifying a syrup from a particular source having its own characteristic impurities. These variables in the operation are then fixed as long as the sugar syrup to be refined has the same characteristics; and they are adjusted when a different syrup is supplied, or a product of different specifications is to be made.

MIXTURES OF SOLVENTS IN EXTRACTION OF SYRUPS

Since the impurities in syrups vary widely, the solvent action necessary for their removal must be quite general — and may not in every case be found in a single liquid. The hydroxyl type solvent is effective and necessary for extracting the highly water soluble impurities. Acetone dissolves selectively the less water soluble oils, fats, and waxes; but it does not remove the inverts and other highly water soluble materials.

To remove both types of impurities, it has been found that the co-solvent, acetone, must be used with the hydroxyl type solvent particularly ethanol to improve the effective solvent action to remove both types of impurities from syrups or molasses or massecuites or if raw sugar crystals are to be purified, and indeed to make the solvent sufficiently immiscible with an impure syrup to permit the extraction operation.

Ethanol and acetic acid are the preferred hydroxyl type solvents, when used with acetone as co-solvent. Methanol also has the desired solvent action but it has some other disadvantages; and it cannot be produced for use as can the other two by the simple fermentation of low value sugar liquors on the site.

Acetone — another solvent which is completely miscible with water and any of the hydroxyl type solvents has a high volatility and low cost. It is used in admixture with one of the preferred solvents of the hydroxyl type, ethanol and acetic acid, or also with methanol. Its use increases the solubility for the oil-fat-wax and some other types of impurities. Acetone, is added in an amount, by volume of from 25 to 50% preferably, or in some cases as much as 80%, increases the selectivity and efficiency of the extraction of the oil-fat-wax type of impurities while retaining the desired selectivity and efficiency of the hydroxyl type solvent for the impurities which are typified by the invert sugars. Its addition to the hydroxyl type solvents is necessary to prevent their miscibility with a syrup and thus to allow the extraction to proceed.

In general the amount of acetone in the mixture with the hydroxyl type solvent to obtain the immiscibility required for extraction has been found to be less at higher temperatures — which are also desirable because of the lower viscosities of the syrups at high temperatures.

The addition of as much as 75% acetone to 25% ethanol by volume for example may be desirable with sugar solutions of solids content not higher than about 60% Brix. However, the acetone by itself, is not able to extract the highly water soluble impurities, e.g. the inverts, and this essential separating ability is that of the ethanol together with the small amount of water in the solvent which may be added to or extracted from the syrup by the hydroxyl type solvent.

The use of methanol or acetic acid as the solvent also requires 75 to 80% by volume of acetone for extracting the impurities of syrups of 70% Brix.

In general, there is used the minimum amount of acetone which will maintain the immiscibility of the solvent and the syrup phases throughout the extraction operation depending on the Brix of the solution, its composition, and temperature, and the ratio of solvent to syrup necessary to give the desired purity. Too much or too little acetone may also cause a precipitation of a fog of extremely fine crystals of sugar in the syrup.

The phase diagram of the solvent-syrup system has many components and hence dimensions. Also the possible variations of temperature and syrup-solvent ratios complicates the prediction of the optimum operation, while adding to the flexibility of the removal of impurities by the counter current contacting of the sugar-water mixture.

Still another possibility in the choice of a solvent mixture for extracting the impurities is the addition to a hydroxyl type solvent of another solvent of relatively low water miscibility, to decrease the solubility of the solvent for water from the syrup. This in amount of from 30 to 60% of the total volume of the hydroxyl type solvent has been found to lower the concentration to about 40 or 50 Brix at most temperatures of the syrup from which the impurities may be extracted, particularly for inverts and the other impurities which are very soluble in water. The water insoluble liquid assists the large amount of dissolved sugar in preventing miscibility of the aqueous sugar solution and the water-soluble hydroxyl solvents.

Of the many such water immiscible solvents, hydrocarbons and chlorinated hydrocarbons have been found to form stable emulsions in the extraction, while water immiscible alcohols have undesirably high boiling points. Isopropyl ether in an amount of 20 to 60% dissolved in the hydroxyl type solvent decreases the minimum concentration of the syrup necessary for extraction, also the selectivity of the solvent for the oils, fats, and waxes without unduly decreasing the selectivity of the solvent for the inverts and for the other impurities which are highly water soluble. The ratio of the volume of co-solvent to the volume of hydroxyl type solvent may be decreased with isopropyl ether as compared to acetone and the ratio of the volume of solvent to the volume of syrup may be increased slightly with the use of an amount of isopropyl ether to secure the desired removal of impurities.

Because beet juice has a greater amount of the impurities which have lesser water solubility and a lesser amount of invert sugars than does cane juice, the addition of a substantially water immiscible solvent to the hydroxyl type solvent is particularly effective in refining beet syrups.

WASHING OF RAW SUGAR CRYSTALS

Impurities are washed from raw sugar crystals by methanol or acetic acid, two hydroxyl type solvents, but not ethanol. Both methanol and acetic acid have major practical disadvantages, not related to their extraction ability, while ethanol has a major advantage in that it can be produced very readily at the sugar production or refining site by a simple fermentation of low value sugar liquids. (Acetic acid can then be made by a second, less simple, fermentation of the ethanol.)

Now it has been found that ethanol may be used for this washing of raw crystalline sugar when from 1% to 5% water is present in the ethanol. Along with the water, the co-solvent acetone is also used in from 5 to 30% preferably, or even higher, in a maximum of 80% of the total solvent, to produce pure sugar crystals. Again, it has been found desirable to acidify the organic acid impurities by maintaining at least a part of the extraction operation at a pH of 1.25 to 1.30 by the addition of a mineral acid.

A SECOND EXTRACTION

The liquid-liquid solvent extraction with any of the several described variations using a hydroxyl solvent and acetone discharges the refined syrup containing some solvent dissolved therein. Also both the liquid-liquid extraction of a sugar syrup or the solvent washing of raw sugar crystals discharges an extract-solvent layer containing most of the impurities contained in most of the syrup or raw sugar respectively which was charged to the extractor. When the solvent is removed from the extract by any suitable means, e.g. by evaporation, the remaining impurities, when working with syrups or raw sugars from cane juice, will be in what may be called a First Extract molasses containing the invert sugars along with oils, fats, waxes, and solid acids.

This First Extract molasses coming from the solvent-extract by the hydroxyl solvent (ethanol or acetic acid, even methanol, with co-solvent) has its solvent removed by evaporation. Its solids concentration is adjusted by evaporation or by dilution with water, as the case may be, to between about 40 to 70 Brix; and it is extracted by from 0.4 to 1.5 times as large a volume fraction acetone with or without isopropyl ether to give a raffinate or aqueous layer; and a new solvent extract layer containing the oils, fats, waxes, and solid acids. After evaporation of the acetone and isopropyl ether, if also present, the values in these impurities in the new or Second Extract may be separated further to be worked up by well known methods.

The impurities of the two types present in the original sugar juice, sugar syrups, or raw sugar and which were substantially all removed by the hydroxyl solvent and co-solvent have now been separated effectively by this second solvent extraction: the oil-fats-wax type in the extract as just mentioned and the invert sugar type in the aqueous raffinate. This has the dissolved solvent removed by evaporation in a multi-cell evaporator or otherwise, to give a sugar syrup or raffinate molasses which may be then evaporated further to give more sugar — of lower purity — and a Third Extract molasses which may be recycled, in part at least, to the first extraction operation or used or sold as such.

An original sugar syrup to be refined may be a concentrated juice from beets. Particularly if it (or the hydroxyl solvent with acetone as a co-solvent to reduce its miscibility) has been acidified so as to give an effective pH in the extraction of as low as 1.25–1.30; this second extraction may be quite unnecessary. Then the hydroxyl solvent extract containing acetone is stripped of solvent to give the First Extract molasses; and the relatively small amount of invert sugars present in beet juice is extracted with water from the water insoluble fats and similar materials, and recycled or worked up as such because of its high vitamin content. The acids which have been sprung at the low pH by the mineral acid treatment are separated from this water insoluble material by known means if of sufficient value, as are also the fats and waxes.

In the use of the hydroxyl solvent with acetone as co-solvent, first in washing a raw sugar or in extracting a syrup or massecuite, most of all of the impurity types are extracted together, then these impurity types may be separated from the First Extract Molasses or syrup by the liquid-liquid extraction using acetone as just described.

If, however, an extraction with acetone, with or without a co-solvent such as 1 to 30% by volume of isopropyl ether, is conducted first, this will remove selectively most of the oils, fats, waxes and solid acids, if sprung with a mineral acid, but not the inverts and related highly water soluble impurities. The impurities removed by the acetone extraction are then separated from the First Extract molasses by known methods. The partially refined syrup may then be extracted to remove inverts and other highly water soluble impurities by a hydroxyl type solvent and co-solvent acetone with or without first stripping off the acetone. In this case the original syrup has had its two types of impurities selectively removed and separated — first oils, fats, waxes, etc., and second the inverts and related materials. Thus the syrup containing the water soluble inverts may be also relatively pure when the hydroxyl solvent is stripped off of it. It may contain, however, some of the other impurities not removed in the extraction for oils, fats, waxes; but the amount of these will be small.

EQUIPMENT FOR OPERATING THE PROCESS

The equipment used in accomplishing the novel process of the invention is, in general, standard and readily available from usual suppliers. Evaporators, grainers, crystallizers, centrifuges, are all long used tools of the sugar refiners' art. Also in common use in many other process industries are the stills — ordinary or azeotropic — condensers, and counter current contactors for the impure sugar-water; i.e. washers or extractors. These in the presence usage would have from about 1 to 10 equilibrium stages, usually 3 to 5.

Most liquid-liquid extractors are vertical towers of considerably greater height than diameter, with appropriate internal parts; and they depend on the appropriate separation of the two liquid phases due to a difference in their densities. Because of the significant difference between the density of any of the preferred solvent mixtures, which has been found satisfactory otherwise, compared with that of the concentrated sugar solutions (above about 40 to 50 Brix, preferably 55 to 80) separation of the two liquid phases is easy and complete. This difference is even greater with massecuites containing a small percentage of crystal sugar which may also be contacted counter currently in an extractor. Also the height of the extractor adds hydrostatic head which is to be considered in designing for pressures necessary to operate with these volatile solvents above their normal boiling points.

In the washing of raw sugar by the preferred solvents or in the counter current contacting of a heavy massecuite, the conventional minglers, of long time service in the standard affination operation are used. These are substantially standard scroll conveyors moving the raw sugar or massecuite against a counter current contacting of the solvent to dissolve impurities and hydraulically to sluice off and carry away the dirt and other extraneous solids.

Somewhat less common than these other types of equipment may be the multi-cell evaporator for concentrating a solution by stages so that only the last stage works with the low temperature drop and less desirable physical characteristics of the most concentrated liquid. However, the multi-cell evaporator also is not novel; and it has been described in many places, e.g. U.S. Pat. No. 3,325,308.

None of the several pieces of equipment nor its design is a part of this invention, the novelty of which resides in the use of these standard items to contact, wash or extract one liquid with another and to separate impurities from the sugar-water combination.

The recovery of solvents and their separation for reuse are standard operations, not a part of this invention — neither is the ultimate separation of the impurities from the raffinate or extract streams of the one or several counter current contacting, extraction, or washing operations delineated above.

I claim:

1. In the process of removing impurities from an original mixture with sugar and from 0.2% to 45% water, the steps comprising:

(a) counter current contacting said water-sugar mixture with a solvent mixture comprising acetone and a second liquid selected from the group consisting of ethanol and acetic acid;

(b) transferring by said counter current contacting said impurities from said original sugar-water mixture to said solvent mixture, and some part of said solvent mixture to said sugar-water mixture;

(c) removing from said counter current contacting operation a second sugar-water mixture containing less of said impurities than was present in said original sugar-water mixture, and some part of said solvent mixture;

(d) separating off for reuse said solvent mixture from said second sugar-water mixture containing less of said impurities;

(e) removing from said counter current contacting operation a solvent-extract liquid containing said solvent mixture and said impurities removed from said original sugar-water mixture; and (f) evaporating off for reuse said solvent mixture from said solvent-extract liquid, thereby producing a first solvent-extract molasses containing said impurities.

2. In the process according to claim 1 wherein said original mixture of sugar and water is a massecuite of sugar crystals in a syrup containing impurities and said second sugar-water mixture is a mixture of crystalline sugar which contains less of said imurities.

3. In a process according to claim 1 wherein said solvent mixture entering said counter current contacting contains from 1 to 5% of water by volume.

4. In a process according to claim 1 wherein the pH of said original sugar-water mixture is reduced to 1.25 to 1.3 by the addition thereto of a mineral acid before said counter current contacting.

5. In a process according to claim 1 wherein a sufficient amount of mineral acid is added to said solvent mixture so that during said counter current contacting said mineral acid in contacting said sugar-water mixture reduces the pH of said sugar-water mixture to a value of 1.25 to 1.3.

6. In a process according to claim 1 wherein said solvent mixture entering said counter current contacting contains from 25 to 80% acetone by volume.

7. In a process according to claim 1 wherein said solvent mixture extracts water from said original sugar-water mixture during said counter current contacting.

8. In the process according to claim 1 wherein at least most of the sugar of said original mixture of sugar and water is present as a crystalline solid and said second sugar-water mixture contains less of said impurities.

9. In a process according to claim 8 wherein, in said counter current contacting, some of said impurities transferred to said solvent mixture are insoluble therein and are hydraulically sluiced away from said original sugar-water mixture and are suspended and removed in said solvent-extract liquid.

10. In a process according to claim 9 wherein said insoluble impurities are mechanically separated from said solvent-extract liquid.

11. In a process according to claim 8 wherein said solvent mixture entering said counter current contacting of said crystalline raw sugar contains from 5% to 30% acetone by volume.

12. In a process according to claim 8 wherein the weight of said solvent mixture is between 0.3 and 3.0 times the weight of said original water-sugar mixture entering the counter-current contacting.

13. In the process according to claim 1 wherein said original mixture of sugar and water is a sugar syrup containing not more than 45% water and said second sugar-water mixture contains less of said impurities.

14. In a process according to claim 13 wherein the volume of said solvent mixture is between 0.3 and 3 times the volume of said syrup entering the counter current contacting.

15. In a process according to claim 13 wherein said original sugar syrup is a solvent-extract molasses previously extracted with a solvent, at least a major part of which was acetone.

16. In a process according to claim 1 wherein said first solvent-extract molasses is adjusted to a Brix of 40 to 70, and is extracted counter-currently with a second solvent, a major part of which is acetone, to give, after evaporating off said solvent, a second solvent-extract molasses containing a higher percentage of said oils, fats, waxes, and solid acids than is in any other liquid stream in said process, also a raffinate sugar syrup containing much of the invert sugars present in the impurities of said original sugar-water mixture.

17. In a process according to claim 16 wherein said second solvent, a major part of which is acetone, contains from 1 to 30% isopropyl ether by volume.

18. In a process according to claim 1 wherein said solvent mixture is fed to said counter current contacting at a temperature differing from the temperature of said original sugar-water mixture by from 1° to 60° C.

19. In a process according to claim 18 wherein the temperature of said solvent mixture is always lower than that of said original sugar-water mixture throughout the entire counter current contacting.

* * * * *